US008343019B2

(12) United States Patent
Friend

(10) Patent No.: US 8,343,019 B2
(45) Date of Patent: Jan. 1, 2013

(54) TAI CHI YOGA BAG

(76) Inventor: Issac Friend, Oak Park, IL (US)

( * ) Notice: Subject to any disclaimer, the term of this patent is extended or adjusted under 35 U.S.C. 154(b) by 0 days.

(21) Appl. No.: 13/026,452

(22) Filed: Feb. 14, 2011

(65) Prior Publication Data

US 2011/0201478 A1 Aug. 18, 2011

Related U.S. Application Data

(63) Continuation-in-part of application No. 12/386,322, filed on Apr. 17, 2009, now abandoned, which is a continuation of application No. 09/977,642, filed on Oct. 15, 2001, now abandoned.

(51) Int. Cl.
*A63B 21/00* (2006.01)

(52) U.S. Cl. ..... 482/105; 482/7

(58) Field of Classification Search ..... 482/105
See application file for complete search history.

(56) References Cited

U.S. PATENT DOCUMENTS 4,997,183 A * 3/1991 Winston ..... 482/105

* cited by examiner

*Primary Examiner* — Jerome w Donnelly
(74) *Attorney, Agent, or Firm* — Cardinal Law Group; Anne K. Burkhart

(57) ABSTRACT

An exercise device in the form of a yoga bag having two ends that hang down over the sides of the chest of a user and provide resistance to the lung cavities during while breathing exercises are performed is set forth. Each end of the bag is provided with compartments for selectively receiving flowable weighted substances. The center of the bag is contoured to fit around the neck.

8 Claims, 3 Drawing Sheets

TAI CHI YOGA BAG

RELATED APPLICATIONS

This application is a continuation in part of U.S. Ser. No. 12/386,322 filed Apr. 17, 2009 now abandoned, which is a continuation of U.S. Ser. No. 09/977,642 filed on Oct. 15, 2001 now abandoned, both of which are incorporated herein.

TECHNICAL FIELD

The present invention relates to exercise equipment and more particularly to a Tai Chi style yoga bag, used for gaining increased benefit from deep breathing exercises that includes an elongated bag device constructed from fabric or any other suitable material and adapted to be worn around the neck of a user and selectively placed over the lungs of the user while engaged in performing yoga and Tai Chi, or any other suitable activity, wherein chest expansion is desired to be increased by the activity.

BACKGROUND

Traditional yoga poses, such as forward and backward bends, can be engaged in to encourage use of full lung capacity and expansion of the lungs. There are many other positions and movements engaged in during the performance of yoga that do not achieve the same opening of the lungs as the aforementioned poses.

SUMMARY

It is an object herein to provide a device that allows you to increase the capacity of the lungs and breathing in numerous other poses and movements which cannot be achieved without the device, wherein. an improved Tai Chi style yoga bag is provided. The Tai Chi style yoga bag includes an elongated bag device constructed from fabric, or any other suitable material, and adapted to be worn around the neck such that weighted compartments are selectively distributed over the lungs. A center of the bag can be contoured to comfortably fit around the neck, such as, for example, by making a shirt collar-type cut to the material at the center, and can be padded for comfort with any suitable material.

Ends of the bag can be provided with suitable compartments that can be selectively filled with, for example, flowable encapsulated heavy weighted substances, such as, for example, sand, pellets, steel shots, or any other suitable material. The flowable substances can be provided in either a sealable or a sealed pouch, wherein the weighted ends can be selectively adjusted in any direction desired, and wherein the bag can be selectively secured to enhance the movement of the user while maintaining the position of the bag.

It is critical to the function of the device that the weighted substances are flowable, rather than solid, in order to maximize the flow of weight over the lungs and optimize the resistance of the weighted substances uniformly against the body, which creates improved elasticity and expansion in the chest during deep rhythmic breathing.

Ideally, the size and configuration of the compartments is selected such that he bag remains foldable when filled with the weighted substance, and is therefore suitable for folding and placing on the diaphragm to engage in three part yoga breathing or for folding into a ball for transporting and storage, if desired.

In an embodiment, the weighted substances can be selectively removed from the sealable pouch and selectively stored in a compartment which can be accessed, for example, by providing Velcro, a zipper, or any other suitable mechanism for selectively opening and closing the compartment. In this manner, the pouch can be accessed via an opening formed in the compartment for filling to adjust the weight within the pouch, rather than having to replace the pouch with a pouch of a different weight.

Alternatively, the pouches can be permanently sealed and permanently placed into the compartments by, for example, stitching, gluing, or any other suitable method for securing the compartment ends about each of the pouches in each of the compartments.

In another embodiment, the bag is provided with any number of suitable joining devices for selectively connecting a left and a right side of the bag together. For example, Velcro tabs, buttons, hook and eye, or any other suitable fastener can be provided for selectively securing a left and a right side of the bag together. Alternatively, where, for example the neck and chest of the user is large, or for any other reason, a connecting strip of, for example Velcro, can be provided that is longer than the illustrated joining devices, to join the left and right side of the bag together. Alternatively, the neck section of the device can be made selectively adjustable to accommodate people whose biometrics are outside of the standard range.

DETAILED DESCRIPTION

A device constructed in accordance with the principles herein can enhance the benefits achieved by engaging in the practice of the Art of Yogic Breathing (Pranayama). Pranayama, the roots of which mean to breathe and to pause, is known as the science of controlled breathing, and is the type of breathing practiced by yogis. A yogis is a person who engages in performing yoga exercises.

The most important consideration in achieving regulated breathing is to control the rhythm. This can be achieved by breathing regularly, and counting out exactly a prescribed rhythm.

Figure 1:
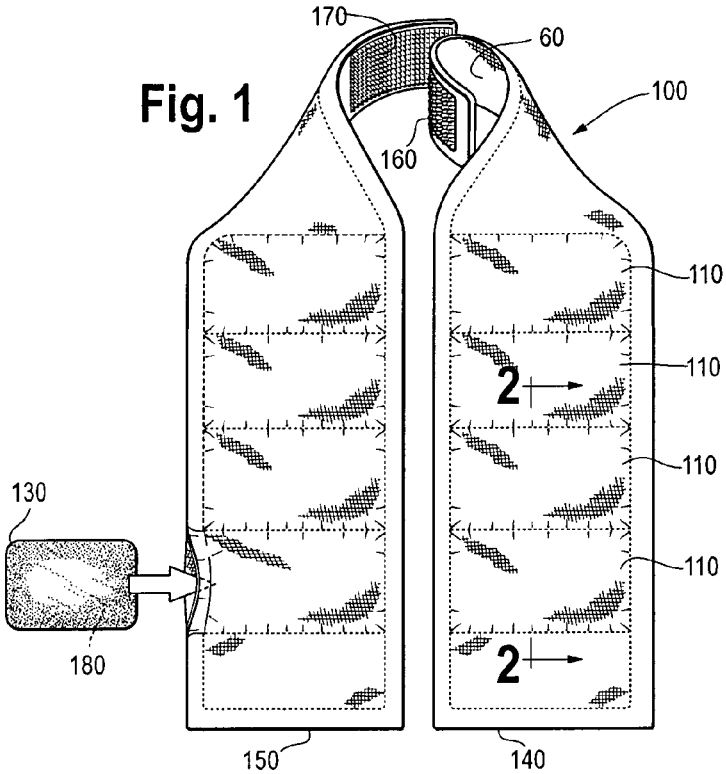
FIG. 1 is a front view of a Tai Chi style yoga bag constructed in accordance with the principles herein.

A Tai Chi Yoga Bag constructed in accordance with the principles herein is used to exercise and strengthen the lungs. A suitable yoga bag, such as the bag illustrated generally at 100 in FIG. 1, includes a number of compartments 110, wherein a pouch 130 containing a weighted flowable substance 180 can be inserted via openings in the compartments, illustrated in FIG. 2.

Figure 2:
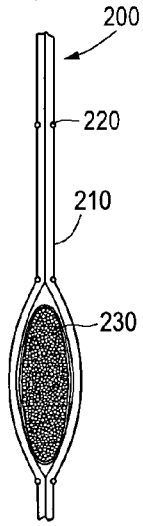
FIG. 2 is a side view of the Tai Chi style yoga bag of FIG. 1, illustrating a sealable compartment.

In the embodiment illustrated in FIG. 2, the compartments 210 can be selectively sealable via suitable closures 220, such as, for example, a stitch line, zipper, Velcro, or any other suitable closure to retain the pouch 230 within. one of the compartments 210. By adding weight over the lungs, the bag 200 provides resistance and helps to expand the breathing capacity of the lungs. The Tai Chi Yoga Bag helps control the prang (breathe) or chi (life force) with the resistance provided during breathing exercises. The pumping action of the lungs moves the air (prana) through the organism and expands the lung cavity further when resistance is encountered in the form of the bag 200.

A Tai Chi Yoga Bag constructed in accordance with the principles herein can be shaped like the lungs themselves. The therapeutic bag should be hung around the neck when in use with each of a right side 140 and a left side 150, illustrated in FIG. 1, distributed equally over the lobes of the lungs. Resistance can also be selectively applied by selectively raising a selected shortening a selected side of the Tai. Chi Yoga Bag 100 by moving selected weighted compartments of a side back to the shoulder.

The yoga bag 100 can be formed of weighted compartments that produce a total an ideal resistance distribution in a variety of weight ranges for the overall bag 100 that can include, but is not limited to, three, six, eight and ten pounds, for example. The six-pound weights can be used, for example, for beginners. The eight and ten-pound yoga bags can be used, for example, for more advanced yogis.

Pranayama includes three breathing components: abdominal, middle, and upper Breathing. The Tai Chi Yoga Bag 100 helps one to pump oxygen through each of the three components during the entire breathing cycle while expanding the lung capacity, thus using the full capacity of the lungs.

Further, exercising all components of Pranayama, or Complete Yogi Breathing (CYB), eliminates impurities from our blood, increases our resistance, and stimulates the metabolism. CYB is particularly successful at regenerating the endocrine glands. other words, expanding the lungs and the capacity of the lungs improves the natural metabolism and efficiency of the bodies systems by increasing the available oxygen supply to the body.

Three part Yogi Breathing at an upper level consists of two stages: inhaling and exhaling. Hold your breath to the count of "1,2,3,4." Exhaling out, to the count of four. Then inhale and hold your breath to the count of 3-12-6 or 4-16-8 or 5-10-15 or 6-24-12. 3-6-9 Modest Measures. Slowest Measure 12-48-24.

High, middle, and low breathing is where most of the expansion of the lungs is in the top, middle, or bottom parts of the chest and lungs thus joining all three in complete Yogi Breathing.

The first consists in the pause, which may he short or long between inhalation and exhalation. The habit of slow, smooth, regular, and effortless breathing can be improved and enhanced when performed using the yoga hag 100 in accordance with the principles herein.

In an embodiment, the yoga bag 100 can include an expandable neck section 160 formed by providing a suitable closure 170 such as, for example, Velcro. In this embodiment, users of varied biometrics can adjust the position of the bag to correct the position of the compartments over the lungs irrespective of neck size.

The compartments 110 can be filled with, for example, pouches 130. The pouches 130 can be sealed or sealable, and can contain a flowable weighted substance 180 as described hereinabove.

The right end 140 and left end 150 hang down over both sides of the chest and rest over the lungs when correctly worn about the neck in an embodiment. A center of the yoga bag 100 can be contoured to fit comfortably about the neck in accordance with the principles herein, such as, for example, by providing a shirt collar-type cut to the material about the neck section 160, as illustrated by the exemplary shape of the neck section 160 in FIG. 1. The neck section 160 can further be padded for added comfort. Each of the ends 140, 150 of the yoga bag 100 can be moved up toward the shoulders of a wearer by moving the weighted compartments 110 back onto the shoulders to adjust the resistance provided to the lung cavity.

Figure 3:
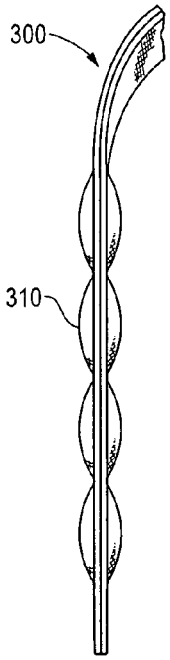
FIG. 3 is an alternative embodiment of a side view of the Tai Chi style yoga bag of FIG. 2, wherein pouches arc permanently sealed in the compartments.

As illustrated in FIG. 3, the compartments 310 can be permanently sealed about the pouches of weighted substance such, for example, by stitching, gluing, or any other suitable method.

Figure 4:
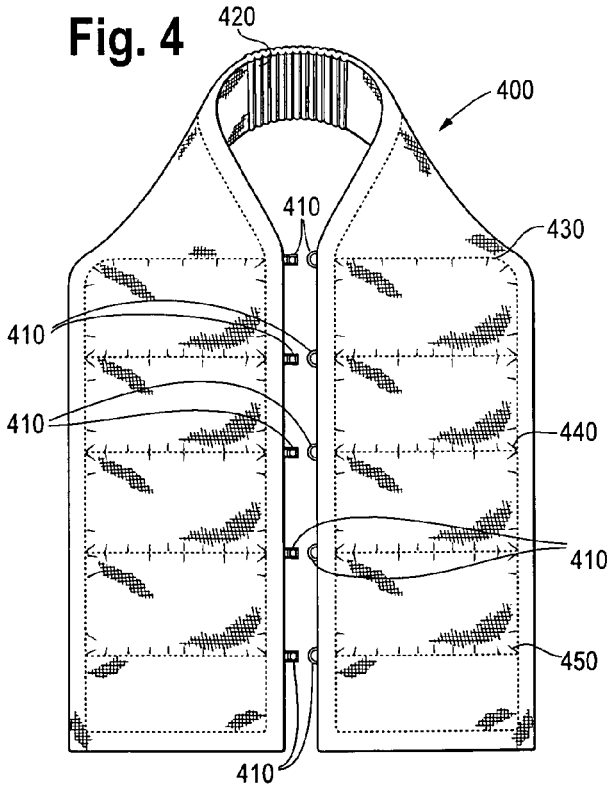
FIG. 4 illustrates a front view of an alternative embodiment, wherein joining members are provided for selectively joining left and right sides of the bag together.
Figure 5:
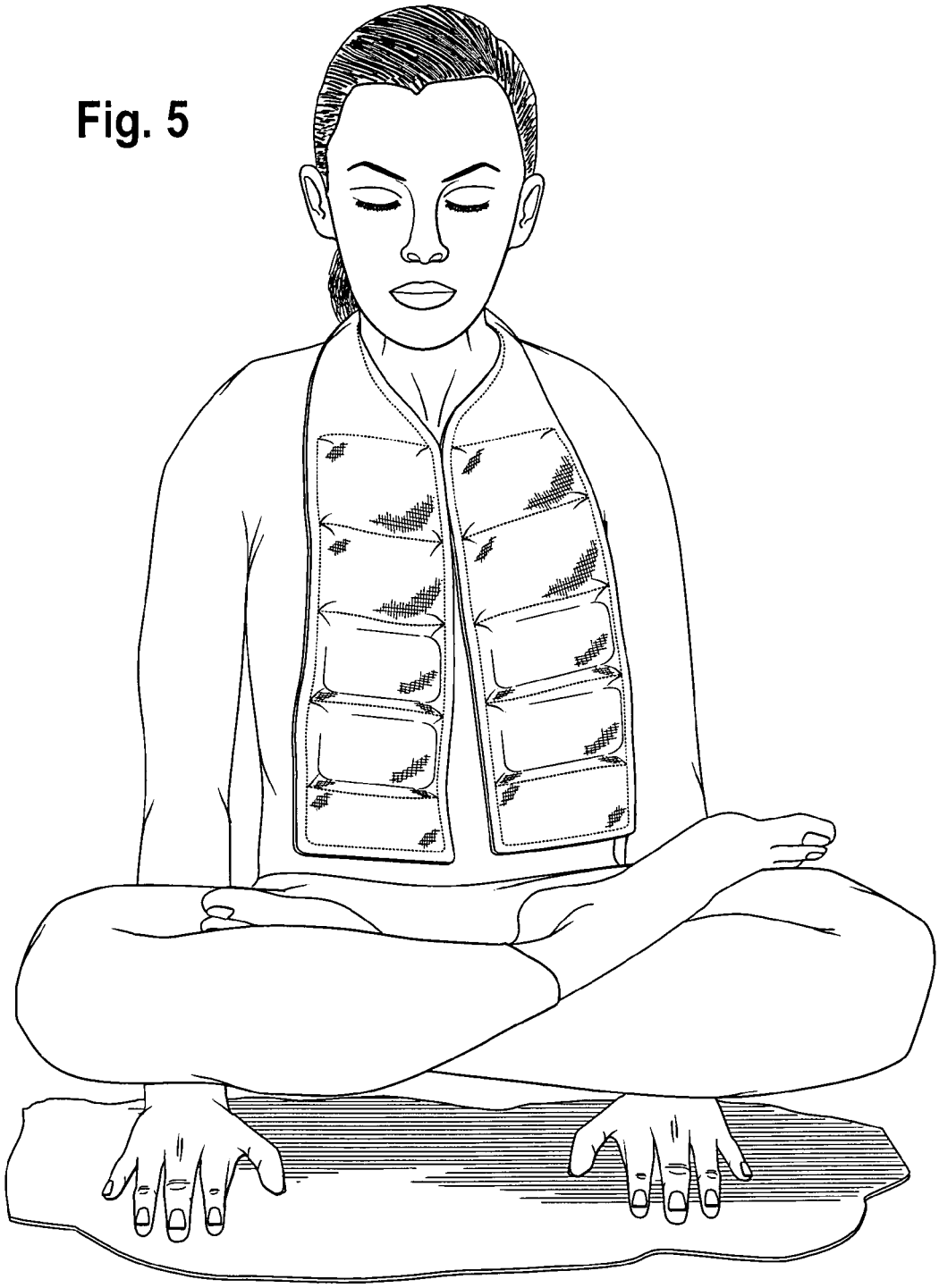
FIGS. 5-10 illustrate exemplary embodiments of a yoga bag constructed in accordance with the principles of the present invention.
Figure 6:
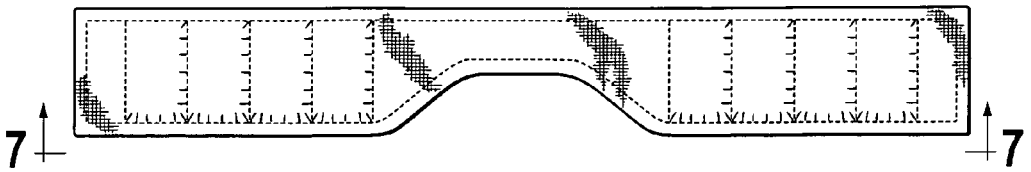
Figure 7:
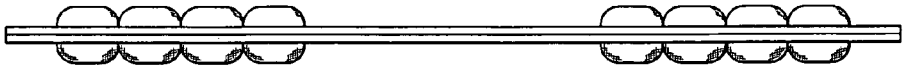
Figure 8:
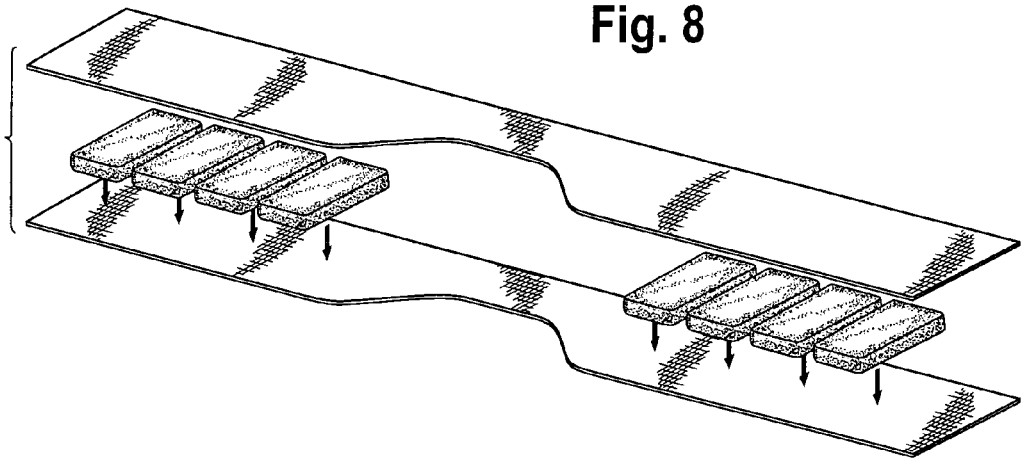
Figure 9:
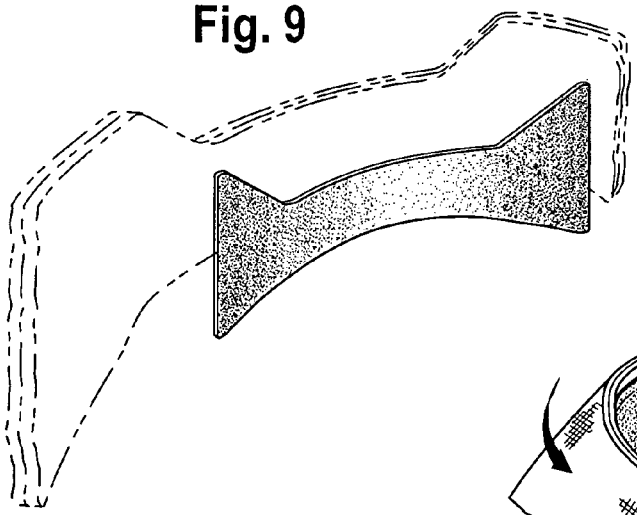
Figure 10:
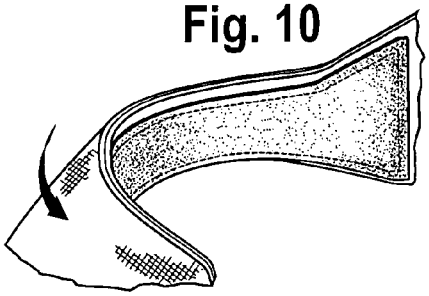

As illustrated in FIG. 4, a neck section 420 can be provided that can include, if desired an elastic material located within the neck section 420 to accommodate variations in neck size. Alternatively, the neck section 420 can be uniformly formed of the fabric used to construct the yoga bag 400. Further, any number of suitable joining devices 410 can be provided at any suitable desired location, such as, for example, a top 430, a middle 440, and a bottom 450 of the yoga bag 400. The joining devices can include any suitable device, such as Velcro tabs or strips, buttons, hook and eye, or any other suitable fastener can be provided for selectively securing a left and a right side of the bag together.

It is noted that the embodiments of the Tai Chi style yoga bag described herein in detail for exemplary purposes only, and are subject to many different variations in structure, design, application and methodology. Because many varying and different embodiments may be made within the scope of the principles herein and because many modifications may be made in the embodiments herein, it is to be understood that the details herein are to be interpreted as illustrative and that the concepts herein can be lawfully embodied in variations of the specific details provided herein.

I claim:

1. A Tai Chi Yoga Breathing Bag comprising: a first elongated bag member forming a right end section adapted to receive a flowing weighted material within multiple compartments, each of said multiple compartments forming a substantially planar surface under which said flowing weighted material can flow in response to motion of a user, each of said compartments containing a pouch wherein the flowing weighted material is stored, said first elongated bag member adapted to cover and extend below a right shoulder blade of a user; a second elongated bag member forming a left end section adapted to receive a flowing weighted material within multiple compartments, each of said compartments containing a pouch wherein the flowing weighted material is stored, each of said multiple pockets forming a substantially planar surface under which said flowing weighted material can flow in response to motion of a user, said second elongated bag member adapted to cover and extend below a left shoulder blade of a user; and an expandable neck section neck section connected to the first elongated bag member and to the second elongated bag member, said neck section having a width that is less than the width of the multiple compartments of the first and second elongated bag members, said neck section contoured to fit around a neck of the user.

2. A Tai Chi Yoga Breathing Bag according to claim 1, further comprising sealable compartments for selectively storing each of the pouches.

3. A Tai Chi Yoga Breathing Bag comprising: a first elongated bag member forming a right end section adapted to receive a flowing weighted material within multiple compartments, each of said multiple compartments forming a substantially planar surface under which said flowing weighted material can flow in response to motion of a user, each of said compartments containing a pouch wherein the flowing weighted material is stored, said first elongated bag member adapted to cover and extend below a right shoulder blade of a user; a second elongated bag member forming a left end section adapted to receive a flowing weighted material within multiple compartments, each of said compartments containing a pouch wherein the flowing weighted material is stored, each of said multiple pockets forming a substantially planar surface under which said flowing weighted material can flow in response to motion of a user, said second elongated bag member adapted to cover and extend below a left shoulder blade of a user; a neck section connected to the first elongated bag member and to the second elongated bag member, said neck section having a width that is less than the width of the multiple compartments of the first and second elongated bag members, said neck section contoured to fit around a neck of the user, and joining closures for selectively joining the left end and the right end of the yoga bag.

4. A Tai Chi Yoga Breathing Bag according to claim 3, wherein the joining closures are formed of a connecting strip of a suitable material.

5. A Tai Chi Yoga Breathing Bag according to claim 3, wherein the joining closures are buttons.

6. A Tai. Chi. Yoga Breathing Bag according to claim 1, further comprising a shirt collar-type cut to the material of the neck section.

7. A Tai Chi. Yoga Breathing Bag according to claim 2, further comprising zippers for selectively sealing the pouches in the compartments.

8. A method of improving breathing while performing Tai Chi Yoga: providing a breathing bag having first and second compartments formed to serve a flowing weight material therein, a flowing material located within said first and second weight compartments, said compartments being extendable below a user's shoulder blades said compartments formed by sewing a seam between adjoining compartments, said compartments constructed to form an interspace there between when selected to conform to the rising and following of the ribs of a user performing Tai Chi yoga; and a neck connector having a shape adapted to rest comfortably on the user's neck, the neck connector connecting the top ends of the first and second t weight compartments, the first and second weight compartments having bottom ends wherein the width of the bottom ends of the first and second weight compartments is greater than the width of both of the top ends of the weight compartments and the neck connector, and placing said breathing bag around the neck of a user to extend below a user's shoulders and then performing a breathing exercise.

* * * * *